US009371994B2

(12) United States Patent
Goodson et al.

(10) Patent No.: US 9,371,994 B2
(45) Date of Patent: Jun. 21, 2016

(54) METHOD FOR ELECTRICALLY-DRIVEN CLASSIFICATION OF COMBUSTION PARTICLES

(71) Applicant: ClearSign Combustion Corporation, Seattle, WA (US)

(72) Inventors: David B. Goodson, Bellevue, WA (US); Tracy A. Prevo, Seattle, WA (US); Joseph Colannino, Bellevue, WA (US); Robert E. Breidenthal, Seattle, WA (US); Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 27 days.

(21) Appl. No.: 14/203,539

(22) Filed: Mar. 10, 2014

(65) Prior Publication Data

US 2014/0251191 A1 Sep. 11, 2014

Related U.S. Application Data

(60) Provisional application No. 61/775,482, filed on Mar. 8, 2013.

(51) Int. Cl.
*B03C 3/00* (2006.01)
*F23J 15/02* (2006.01)

(52) U.S. Cl.
CPC ..... *F23J 15/022* (2013.01)

(58) Field of Classification Search
CPC ..... B03C 3/68; F01N 3/01; G01N 27/62; G01N 15/0656; H01J 49/022
USPC ..... 95/3; 96/19, 62; 73/23.31, 28.01; 250/288; 324/464
See application file for complete search history.

(56) References Cited

U.S. PATENT DOCUMENTS

| | | | |
|---|---|---|---|
| 2,604,936 | A | 7/1952 | Kaehni |
| 3,416,870 | A | 12/1968 | Wright |
| 3,841,824 | A | 10/1974 | Bethel |
| 4,093,430 | A | 6/1978 | Schwab et al. |
| 4,675,029 | A | 6/1987 | Norman et al. |
| 5,288,303 | A | 2/1994 | Woracek et al. |
| 5,300,270 | A | 4/1994 | Krigmont et al. |
| 6,211,490 | B1 | 4/2001 | Nosse |
| 7,137,808 | B2 | 11/2006 | Branston et al. |

(Continued)

FOREIGN PATENT DOCUMENTS

| | | |
|---|---|---|
| EP | 1139020 | 8/2006 |
| WO | WO 2014/005143 | 1/2014 |

(Continued)

OTHER PUBLICATIONS

U.S. Appl. No. 14/061,477, filed Oct. 3, 2013, Krichtafovitch et al.

*Primary Examiner* — Duane Smith
*Assistant Examiner* — Minh-Chau Pham
(74) *Attorney, Agent, or Firm* — Christopher A. Wiklof; Nicholas S. Bromer; Launchpad IP, Inc.

(57) ABSTRACT

In a combustion system, a charge source is configured to cooperate with a collection plate and a director conduit to cause at least one particle charge-to-mass classification to be reintroduced to a flame for further reaction.

17 Claims, 5 Drawing Sheets

(56) References Cited

U.S. PATENT DOCUMENTS

| | | | | |
|---|---|---|---|---|
| 7,243,496 | B2 | 7/2007 | Pavlik et al. | |
| 7,837,962 | B2 | 11/2010 | Eiteneer et al. | |
| 8,851,882 | B2 | 10/2014 | Hartwick et al. | |
| 8,911,699 | B2 | 12/2014 | Colannino et al. | |
| 2005/0208442 | A1 | 9/2005 | Heiligers et al. | |
| 2006/0156791 | A1* | 7/2006 | Tikkanen et al. | G01N 27/62 73/23.31 |
| 2007/0020567 | A1 | 1/2007 | Branston et al. | |
| 2007/0071657 | A1 | 3/2007 | Okubo et al. | |
| 2010/0000404 | A1* | 1/2010 | Sakuma et al. | G01N 15/0656 95/3 |
| 2011/0072786 | A1 | 3/2011 | Tokuda et al. | |
| 2011/0203771 | A1 | 8/2011 | Goodson et al. | |
| 2012/0262182 | A1* | 10/2012 | Matsuoka et al. | G01N 15/0656 324/464 |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0038113 | A1 | 2/2014 | Breidenthal et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Krichtafovitch et al. | |
| 2014/0170576 | A1 | 6/2014 | Colannino et al. | |
| 2014/0170577 | A1 | 6/2014 | Colannino et al. | |
| 2014/0186778 | A1 | 7/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0234786 | A1 | 8/2014 | Ruiz et al. | |
| 2014/0234789 | A1 | 8/2014 | Ruiz et al. | |
| 2014/0248566 | A1 | 9/2014 | Krichtafovitch et al. | |
| 2014/0255855 | A1 | 9/2014 | Krichtafovitch | |
| 2014/0255856 | A1 | 9/2014 | Colannino et al. | |
| 2014/0287368 | A1 | 9/2014 | Krichtafovitch et al. | |
| 2014/0295094 | A1 | 10/2014 | Casasanta et al. | |
| 2014/0326873 | A1* | 11/2014 | Kokubo | H01J 49/022 250/288 |
| 2014/0338350 | A1 | 11/2014 | Breidenthal | |
| 2014/0366736 | A1* | 12/2014 | Hirth et al. | F01N 3/01 96/62 |
| 2015/0079524 | A1 | 3/2015 | Colannino et al. | |
| 2015/0107260 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0241057 | A1 | 8/2015 | Krichtafovitch et al. | |

FOREIGN PATENT DOCUMENTS

| | | |
|---|---|---|
| WO | WO 2014/099193 | 6/2014 |
| WO | WO 2014/105990 | 7/2014 |
| WO | WO 2014/127306 | 8/2014 |
| WO | WO 2015/017084 | 2/2015 |
| WO | WO 2015/051136 | 4/2015 |
| WO | WO 2015/051377 | 4/2015 |

* cited by examiner

METHOD FOR ELECTRICALLY-DRIVEN CLASSIFICATION OF COMBUSTION PARTICLES

The present application claims priority benefit from U.S. Provisional Patent Application No. 61/775,482, entitled "ELECTRICALLY-DRIVEN CLASSIFICATION OF COMBUSTION PARTICLES", filed Mar. 8, 2013; which, to the extent not inconsistent with the disclosure herein, is incorporated by reference.

SUMMARY

According to an embodiment, a combustion system may include a burner, a nozzle or an injector that may dispense a steam of fuel or a mixture of fuel and air into a combustion volume, which is ignited to provide a flame. During combustion, the flame may include a flow of exhaust (also referred to as flue gases herein) that includes a plurality of particles including burned combustion products, unburned fuel and air. The combustion system may employ one or more methods for charging and redirecting the particles included in the exhaust or flue gases emanating from the combustion system. The particles may be recirculated into the flame, such as to improve combustion efficiency and reduce the concentration of these recirculated particles in the exhaust gases for disposal. According to various embodiments, a method for charging the exhaust gases from a combustion process may be implemented using a corona discharge device that includes two or more discharge electrodes that may create an ionic wind to charge emission particles. Other charging methods may include utilizing fluxes of x-rays, laser beams, radiation material enrichment-like processes, and various electrical discharge processes. In some embodiments, a charge electrode is disposed in contact with a conductive portion of a combustion reaction and is driven to carry a high voltage, to cause the conductive portion of the combustion reaction to carry a similar voltage.

The application of an electric field by corona discharge electrodes may be controlled by one or more control systems.

In other embodiments, particles entrained in the exhaust gases may pass through an ionic wind produced by the corona discharge where positively charged particles may be generated such that these charges may attach to all or most of the entrained particles to create charged particles. The charged particles may then be collected by an oppositely charged collector plate that may be placed above and away from the combustion volume. Larger particles may receive a lower charge to mass ratio and may be more poorly attracted to the collector plate, while smaller particles may receive a higher charge-to-mass ratio and may be more easily attracted by the collector plate. Particle size in exhaust gas has been found to be fuel dependent, but for some fuels, the desired particle size to be collected range from about 0.1 μm to about 10 μm.

In another embodiment, particles in the exhaust gases passing through an ionic wind to generate charged particles selected to be attracted by a director conduit. The director conduit may redirect or recirculate these particles back into the flame within the combustion volume where any remaining fuel contained by the redirected particles is oxidized and where the concentration of these particles is further reduced. Re-burned particles in the exhaust gases may then be charged during another cycle of corona discharge application and may be collected by a collector plate for later disposal according to an embodiment.

The structures and methods disclosed in the present disclosure may improve the efficiency of combustion processes since more energy may be produced by the same amount or quantity of reactants. Additionally, particle emissions may be decreased when being re-burned and particulate pollution thereby reduced. Furthermore, charging of exhaust particles and their collection and disposal employing the collector plate may decrease the complexity of disposal methods while reducing emission levels.

Numerous other aspects, features and benefits of the present disclosure will become apparent from the following detailed description taken together with the associated figures.

BRIEF DESCRIPTION OF THE DRAWINGS

Various embodiments of the present disclosure are described by way of example with reference to the accompanying figures, which are schematic and are not intended to be drawn to scale. Unless indicated as representing the prior art, the figures represent aspects of the present disclosure.

DETAILED DESCRIPTION

Figure 1:
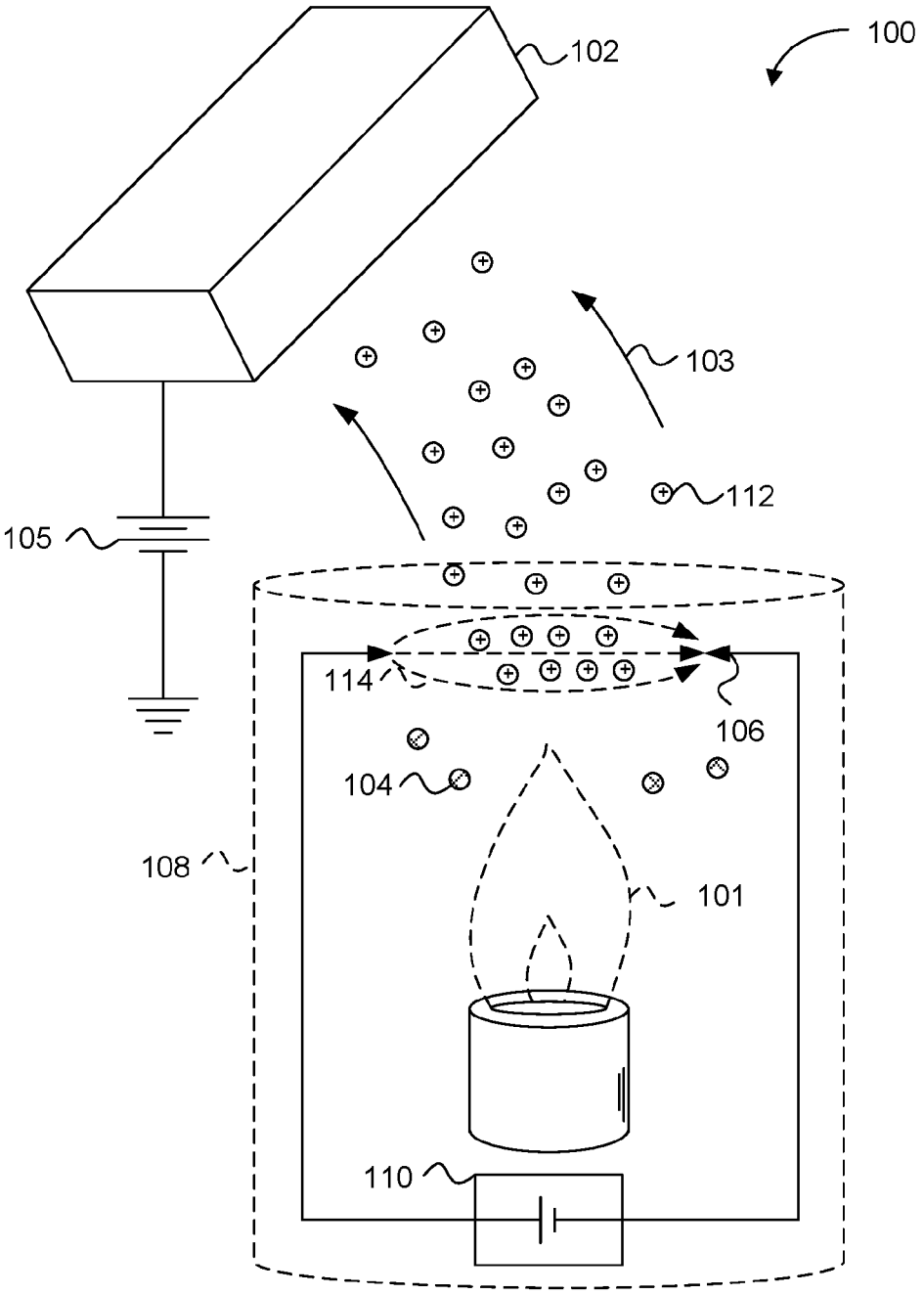
FIG. 1 depicts an embodiment of a combustion system employing a corona discharge structure and a collector plate, according to an embodiment.

In the following detailed description, reference is made to the accompanying drawings, which form a part hereof. In the drawings, which are not to scale or to proportion, similar symbols typically identify similar components, unless context dictates otherwise. The illustrated embodiments described in the detailed description, drawings and claims, are not meant to be limiting. Other embodiments may be used and/or other changes may be made without departing from the spirit or scope of the present disclosure.

As used herein, the following terms may have the following definitions:

"corona discharge" may refer to an electrical discharge, either positive or negative, produced by the ionization of a fluid surrounding an electrically energized conductor.

"ionic wind" may refer to a stream of ions generated from a tip electrode by a strong electric field exceeding a corona discharge voltage gradient and that may be used to charge exhaust combustion particles.

FIG. 1 depicts an embodiment of a combustion system 100 employing a corona discharge device using at least two sharp shaped electrodes 106, i.e., electrodes that taper to a sharp tip directed outward toward the combustion exhaust gases 103 and a collector plate 102, according to an embodiment. Suitable materials for the collector plate 102 may include conductive materials such as iron, steel (such as stainless steel), copper, silver or aluminum or alloys of each of these metals provided that the preponderant constituent of the alloy consists of iron, steel, copper, silver or aluminum. Combustion itself may be provided for though a variety of fuels such as solid, liquid and gas hydrocarbon fuels together with various oxidizers, the most common being ambient air. Other fuel and oxidizer combinations are also possible.

In order to accomplish a simultaneous charging and collection of exhaust particles 104, electrodes 106 may be placed at either side of a combustion volume 108 above flame 101, and charged with a sufficiently high voltage to generate a corona discharge. Voltage may be applied to electrodes 106 by a high voltage power source (HVPS) 110.

In order to generate a corona discharge one or both electrodes 106 is configured to taper to a sharp tip, which can produce a projection of ions near the end of this tip when excited by voltages above a minimum ionization limit. Corona discharge is a process by which a current flows from one electrode 106 with a high voltage potential into a zone of neutral atmospheric gas molecules such as is present in the combustion exhaust gases 103 adjacent to the tips of electrodes 106. These neutral molecules can be ionized to create a region of plasma around electrode 106. Ions generated in this manner may eventually pass charge to nearby areas of lower voltage potential, such as at collector plate 102, or they can recombine to again form neutral gas molecules.

When the voltage potential gradient, or electric field, is large enough at a point in the area where a corona discharge is established, neutral air molecules may be ionized and the area may become conductive. The air around a sharp shaped electrode 106 may include a much higher voltage potential gradient than elsewhere in the area of neutral air molecules. As such, air near electrodes 106 may become ionized, while air in more distant areas may not. When the air near the tips of sharp shaped electrodes 106 becomes conductive, it may have the effect of increasing the apparent size of the conductor. Since the new conductive region may be less sharp, the ionization may not extend past this local area. Outside this area of ionization and conductivity, positively charged air molecules may move in the direction of an oppositely charged object such as collector plate 102, where they may be neutralized and/or collected. The collector plate 102 may be maintained at a respective polarity by being connected to ground through a voltage or current source 105.

The movement of these ions generated by a corona discharge, therefore, may form an ionic wind 114. When exhaust particles 104 pass through ionic wind 114, ions may be attached to so or all of exhaust particles 104 such that particles 104 become positively charged to provide charged particles 112.

When the geometry and voltage potential gradient applied to a first conductor increase such that the ionized area continues to grow until it can reach another conductor at a lower potential, a low resistance conductive path between the two conductors may be formed, resulting in an electric arc.

Corona discharge, therefore, may be generally formed at the highly curved regions on electrodes 106, such as, for example, at sharp corners, projecting points, edges of metal surfaces, or small diameter wires. This high curvature may cause a high voltage potential gradient at these locations on electrodes 106 so that the surrounding air breaks down to form a plasma. The electrodes 106 are preferably driven to a voltage sufficiently high to eject ions, but sufficiently low to avoid causing dielectric breakdown and associated plasma formation. The corona discharge may be either positively or negatively charged depending on the polarity of the voltage applied to electrodes 106. If electrodes 106 are positive with respect to collector plate 102, the corona discharge will be positive and vice versa. Typically charges of either sign are deposited on molecules and/or directly onto larger particulates. Charges deposited onto molecules tend to transfer to larger particles (e.g. onto particles including carbon chains with a relatively large number of carbon atoms). Particles including carbon chains essentially constitute unburned fuel. It is desirable to recycle carbon into the combustion reaction to achieve more complete combustion.

Moreover, charges tend to collect on metals and metal-containing particulates including mercury, arsenic, and/or selenium. According to embodiments, structures and functions disclosed herein are arranged to remove metal cations from flue gas.

In some embodiments, ions in ionic wind 114 can have a constant positive polarity. Positively charged particles 112 may be attracted by collector plate 102 which may be negatively charged. Particles 104 which are larger may obtain more charge due to a larger area exposed to receive more positive ions, for example. Charged particles 112 sized between about 0.1 μm and about 10 μm may be more easily attracted and collected by collector plate 102, while charged particles 112 with size smaller than about 0.1 μm can exit combustion system 100 without being attracted by collector plate 102. Re-entrainment of charged particles 112 larger than 10 μm into combustion volume 108 or disposal within a suitable storage component of combustion system 100 (not shown) may reduce exhaust emissions, including but not limited to soot and unburned fuel that may be contained within particles 104.

In other embodiments, ions in ionic wind 114 can have a negative polarity.

In still other embodiments, charging the combustion reaction can be omitted. A collector plate 102 or director conduit 202 (see FIG. 2) can attract charged particles such as metal cations from the flue gas.

Other charging methods can, for example, include utilizing fluxes of x-rays or laser beams, radiation material enrichment-like processes, and various electrical discharge processes. The application of an electric field by a corona discharge generated by an application of high voltage at electrodes 106 may be controlled by a combustion control system.

According to another embodiment, the collector plate 102 may include an electrical conductor coupled to receive a second polarity electrical potential from a node (not shown) operatively coupled to the HVPS 110. The collector plate 102 may be disposed above and away from the combustion volume 108 distal to the flame 101, arranged to cause at least one particle classification to flow to a collection location and to cause at least one different particle classification to flow to one or more locations different from the collection location. The main particle flow may typically be aerodynamic. The differentiation between the collected particles and uncollected particles may be based at least partly on the response of a characteristic charge-to-mass ratio (Q/m) of the collected particles.

In yet another embodiment, a director conduit may be configured to receive the flow of the selected particle classification at a first collection location and to convey the flow of at the least one particle classification to an output location. The output location may be selected to cause the output flow of the selected particle classification to flow back toward the flame 101. For example, unburned fuel particles may be relatively heavy, and have a tendency to carry positive charges on their surface. According to yet another embodiment, the described system can recycle the unburned fuel to the flame 101. For example, this can allow higher flow rates than could normally be sustained with high combustion efficiency.

Figure 2:
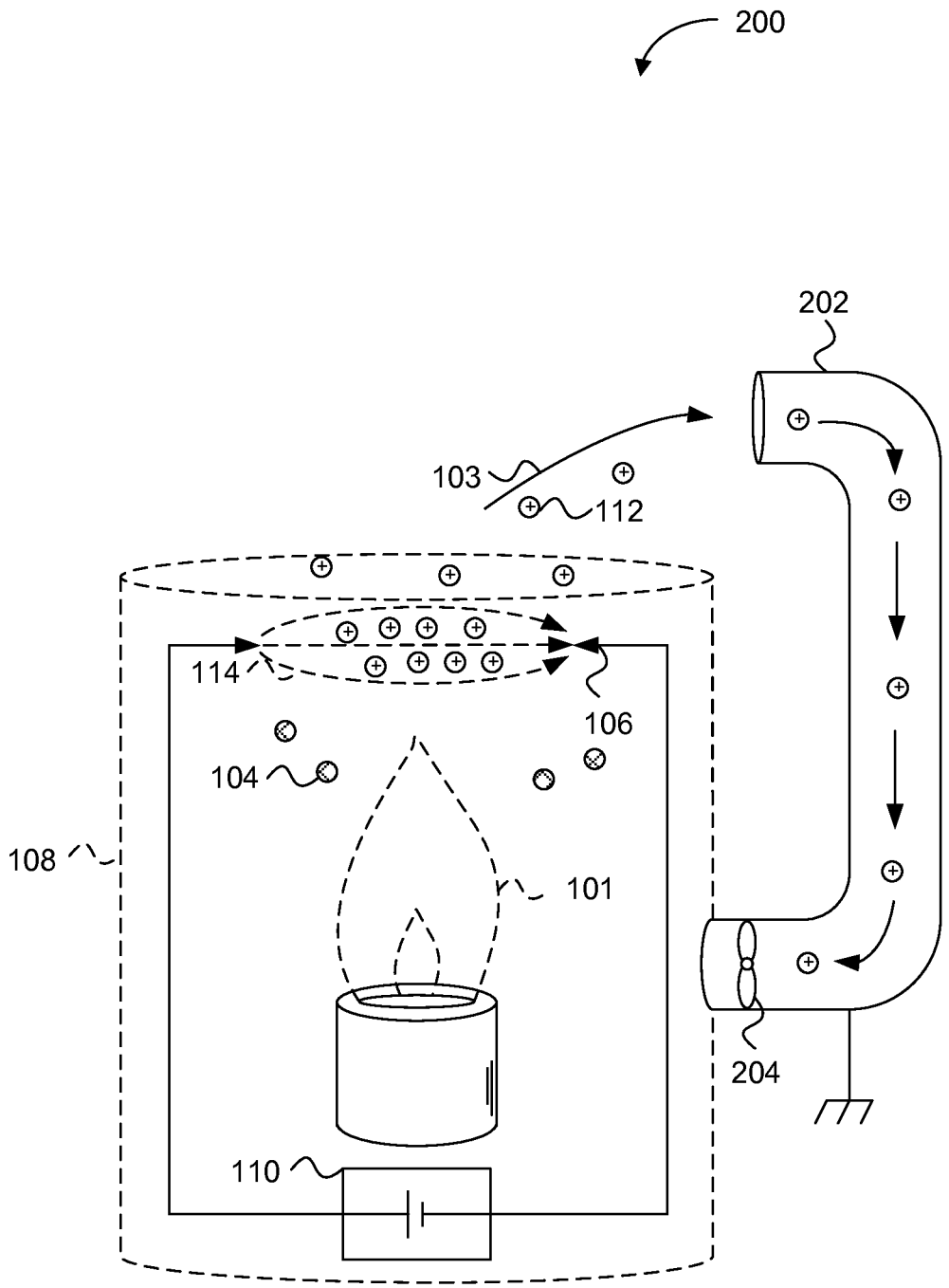
FIG. 2 shows an embodiment of a combustion system employing a corona discharge structure and a director conduit, according to an embodiment.

FIG. 2 shows an embodiment of a combustion system 200 employing a corona discharge device, as described in FIG. 1, and the director conduit 202. Particles 104 charged by ionic wind 114 generated by a corona discharge created by the application of a high voltage to electrodes 106, provide charged particles 112, in an embodiment. Charged particles 112 may exit combustion volume 108 and may be attracted to director conduit 202 which may be polarized or grounded such that director conduit 202 may be negatively charged with respect to positively charged particles 112. A fan or impeller 204 may be placed inside director conduit 202 to provide additional dragging force to attract charged particles 112 back into combustion volume 108 where charged particles 112 may be re-burned or disposed of into a suitable storage location (not shown) in combustion system 200. As described in FIG. 1, larger particles 104 may obtain more charge than smaller particles 104, therefore, particles 104 of a size raging from about 0.1 μm to about 10 μm may be more easily attracted to director conduit 202. After re-burning, charged particles 112 may be consumed or may be agglomerated to a size larger than about 0.1 μm, and thus may exit combustion system 200 without being attracted by director conduit 202. Fan or impeller 204 may generate a vacuum pressure selected to reduce sedimentation of charged particles 112 in director conduit 202. Suitable materials for director conduit 202 may include a variety of insulated and/or dielectric materials such as elastomeric foam, fiberglass, ceramics, refractory brick, alumina, quartz, fused glass, silica, VYCOR™, and the like.

Figure 3:
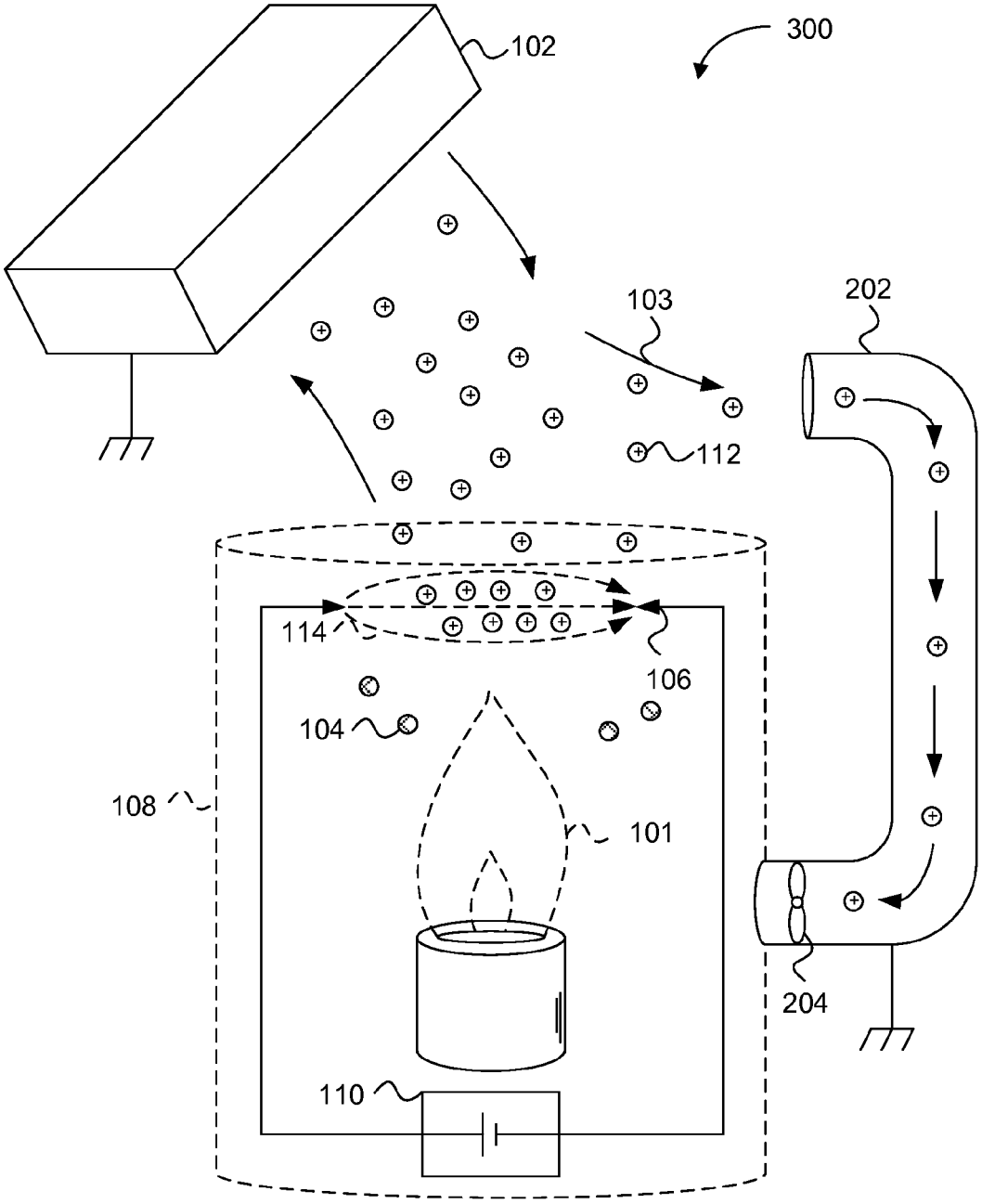
FIG. 3 illustrates an embodiment of combustion system employing a corona discharge structure, a director conduit and a collector plate, according to an embodiment.

In still another embodiment, FIG. 3 illustrates a combustion system 300 employing a corona discharge device and a collector plate 102, as described in FIG. 1, and a director conduit 202, as described in FIG. 2. Particles 104 may again be charged by ionic wind 114 generated by a corona discharge created by the application of a high voltage to electrodes 106 to provide charge particles 112. The charged particles 112 may exit combustion volume 108 and may be attracted to director conduit 202 which may be polarized or grounded such that director conduit 202 may be negatively charged with respect to positively charged particles 112. As before, director conduit 202 may include an inlet port disposed above the combustion volume, an outlet port disposed adjacent to the flame, a tubular body between the inlet and outlet ports. Fan or impeller 204 may be placed inside director conduit 202 to provide additional dragging force to draw charged particles 112 back into combustion volume 108 where charged particles 112 may be re-burned. Fan or impeller 204 may also generate a vacuum pressure which may reduce sedimentation of charged particles 112 in director conduit 202. Suitable materials for director conduit 202 may again include insulated and dielectric materials such as elastomeric foam, fiberglass, ceramics, refractory brick, alumina, quartz, fused glass, silica, VYCOR™, and the like.

Finally, particles 104 in exhaust gases that are recirculated trough flame 101 and re-burned may be charged again during another cycle of corona discharge application and may be collected by collector plate 102 for later disposal according to established methods for exhaust gas emissions.

Figure 4:
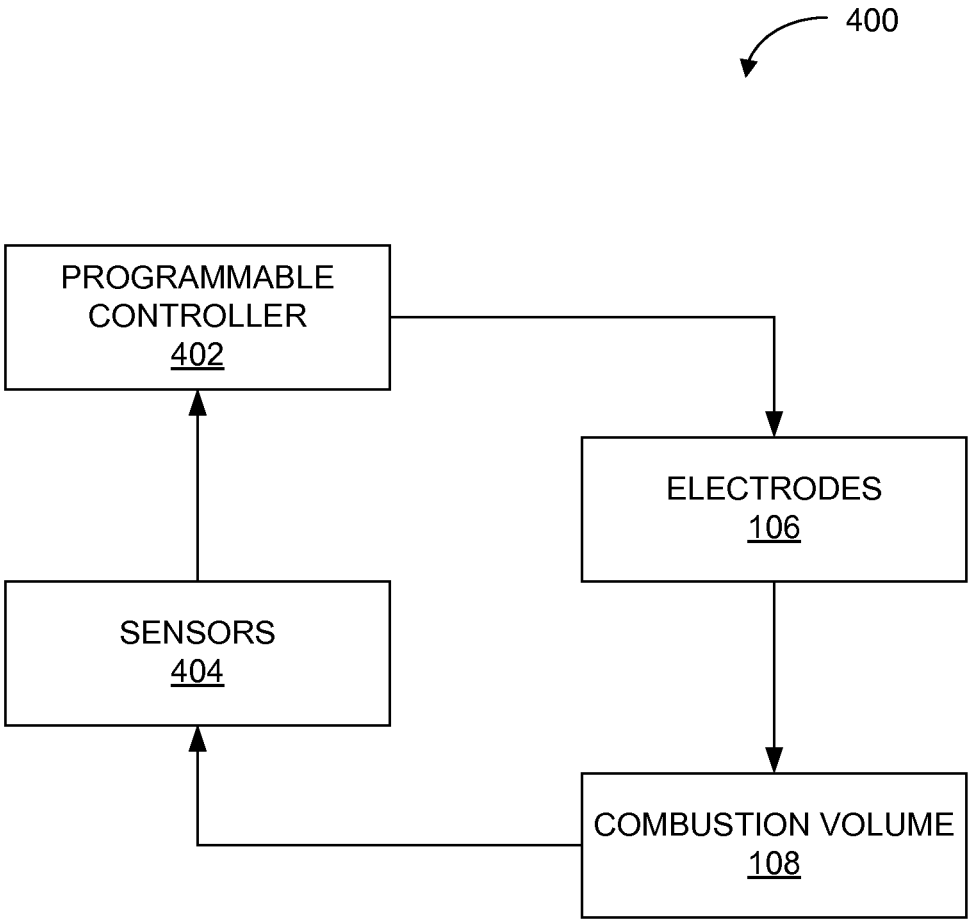
FIG. 4 shows a block diagram of a combustion control system employed in the present disclosure, according to an embodiment.

FIG. 4 is a block diagram of combustion control system 400 that may be integrated in combustion systems 100, 200, and 300, according to an embodiment. Programmable controller 402 may determine and control the necessary electric field for the generation of a corona discharge from HVPS 110 to apply suitable voltages to electrodes 106 based on information received from sensors 404. Sensors 404 may be placed inside combustion volume 108 to send feedback to programmable controller 402 to determine the voltage potential gradient required to establish the corona discharge. Combustion control system 400 may include a plurality of sensors 404 such as combustion sensors, temperature sensors, spectroscopic and opacity sensors, and the like. The sensors 404 may also detect combustion parameters such as, for example, a fuel particle flow rate, stack gas temperature, stack gas optical density, combustion volume temperature and pressure, luminosity and levels of acoustic emissions, combustion volume ionization, ionization near one or more electrodes 106, combustion volume maintenance lockout, and electrical fault, amongst others. The information (sensor output data) provided by the plurality of sensors 404 may be typically in the form of continuous, discrete voltage output data (e.g., ±5V, ±12V) several times a second which is compared against predetermined (preprogrammed) values, in real time, within programmable controller 402.

Figure 5:
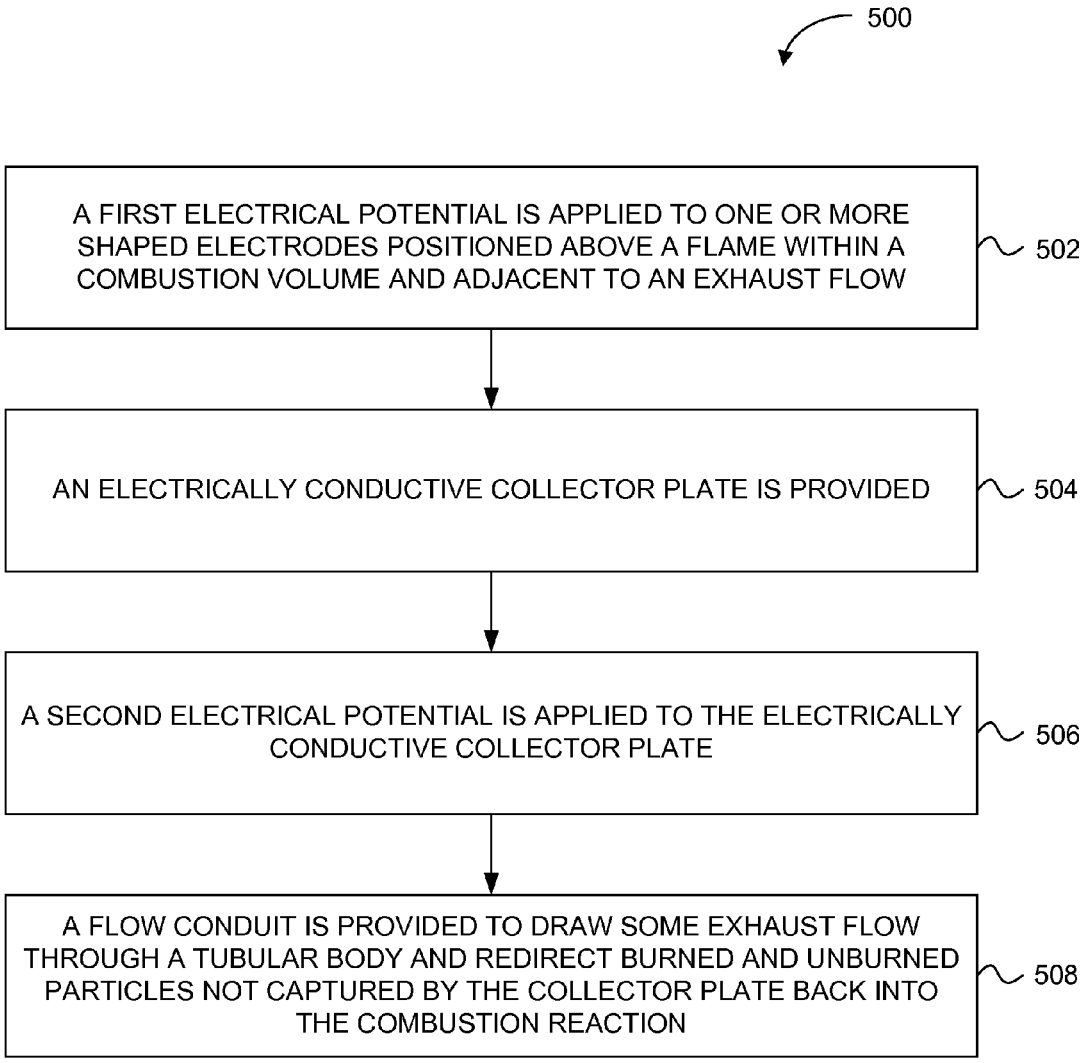
FIG. 5 is a flow chart of a method for reducing the size and number of particles entrained within an exhaust flow leaving a combustion system, according to an embodiment.

FIG. 5 is a flow chart of a method 500 for reducing the size and number of particles entrained within an exhaust flow leaving a combustion system, according to an embodiment. The method 500 includes step 502, a first electrical potential is applied to one or more shaped electrodes positioned above a flame within a combustion volume and adjacent to an exhaust flow comprising a plurality of burned and unburned particles leaving the combustion volume. The one or more shaped electrodes may be tapered to a sharp tip directed into the exhaust flow. The applied electrical potential may generate a corona discharged proximate to the sharp tip of each of the one or more shaped electrodes. The corona discharge may generate an ionic wind passing through the exhaust flow. A portion of the plurality of burned and unburned particles may acquire an electric charge having a first polarity.

In step 504 an electrically conductive collector plate is provided. The collector plate may be disposed above and away from the combustion volume distal to the flame.

In step 506, a second electrical potential is applied to the electrically conductive collector plate. The second electrical potential may have a polarity opposite that of the first polarity, wherein some fraction of the plurality of the charged particles may be collected at a surface of the collector plate.

In step 508, a "flow" or director conduit is provided. The director conduit may include an inlet port disposed above the combustion volume, an outlet port disposed adjacent to the flame, a tubular body between the inlet and outlet ports, and a fan, impeller or vacuum means for drawing some portion of the exhaust flows through the tubular body thereby redirecting some portion of the burned and unburned particles not captured by the collector plate back into the combustion volume.

Finally, while various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method for reducing particles entrained within an exhaust flow leaving a combustion system, comprising the steps of:

applying a first electrical potential between shaped electrodes that are positioned above a flame within a combustion volume and are adjacent to the exhaust flow leaving the combustion volume, thereby generating an ionic wind between the shaped electrodes, such that the exhaust flow-entrained particles pass through the ionic wind;

generating a corona discharge proximate to the shaped electrodes, thereby providing the ionic wind, the ionic wind comprising a plurality of electric charges passing through the exhaust flow;

depositing at least a fraction of the electric charge having a first polarity onto at least a fraction of the plurality of particles when the particles pass through the ionic wind and ions of the ionic wind become attached to the particles, such that the particles become charged;

providing an electrically conductive collector plate, the collector plate disposed above and away from the combustion volume distal to the flame; and applying a second electrical potential between ground and the electrically conductive collector plate, the second electrical potential having an attractive polarity, whereby at least a fraction of the plurality of charged particles is collected at a surface of the collector plate.

2. The method of claim 1, wherein the step of generating a corona discharge proximate to the shaped electrodes includes providing at least one shaped electrode that is tapered to a sharp tip.

3. The method of claim 2, wherein the step of generating a corona discharge proximate to the shaped electrodes further includes generating a high voltage potential proximate to the at least one shaped electrode that is tapered to a sharp tip.

4. The method of claim 3, wherein the ionic wind is partly responsible for causing the fraction of the plurality of the charged particles to flow to the surface of the collector plate.

5. The method of claim 4, wherein the collector plate includes an electrically conductive surface proximate to the exhaust flow.

6. The method of claim 5, wherein the electrically conductive surface includes a metal.

7. The method of claim 6, wherein the metal is iron, steel, copper, silver or aluminum, or alloys of each, wherein the preponderant constituent of the alloy consists of iron, steel, copper, silver or aluminum.

8. The method of claim 7, further including the step of providing a director conduit configured to receive a flow of at least a fraction of the plurality of particles at an input location and to convey the flow to an output location.

9. The method of claim 8, wherein the director conduit includes an inlet port disposed above the combustion volume proximate the input location disposed away from the collection plate, an outlet port disposed adjacent the combustion volume proximate the flame, and a hollow body connecting the inlet and outlet ports.

10. The method of claim 9, wherein the director conduit further includes a fan, impeller or vacuum means to provide an additional dragging force on at least a fraction of the plurality of particles through the hollow connecting body from the inlet port to the outlet port.

11. The method of claim 10, wherein the output location is selected to cause the flow of the at least a fraction of the plurality of particles to flow toward the flame.

12. The method of claim 8, wherein the director conduit includes a dielectric or insulator material.

13. The method of claim 12, wherein the dielectric or insulator material is selected from the list consisting of elastomeric foam, fiberglass, ceramics, refractory brick, alumina, quartz, fused glass, silica, VYCOR™, and combination thereof.

14. The method of claim 1, further comprising providing a director conduit comprising an inlet port disposed above the combustion volume, an outlet port disposed adjacent to the flame, a tubular body between the inlet and outlet ports, and a fan, impeller or vacuum means for drawing a fraction of the exhaust flow through the tubular body thereby redirecting a fraction of the plurality of particles not captured by the collector plate back into the combustion volume.

15. The method of claim 1 or 14, further including the step of providing one or more sensors in electrical communication with a programmable controller.

16. The method of claim 15, wherein the one or more sensors each provide a plurality of time-sequenced sensor inputs to the programmable controller.

17. The method of claim 16, wherein the programmable controller changes the electrical potential applied by a high voltage power supply (HVPS) to the one or more shaped electrodes from time-to-time based on a comparison of the plurality of time-sequenced sensor inputs received by the programmable controller against a set of one or more predetermined values preprogrammed onto the programmable controller.

* * * * *